US011479885B2

(12) United States Patent
Brandt

(10) Patent No.: US 11,479,885 B2
(45) Date of Patent: Oct. 25, 2022

(54) APPARATUS FOR TEXTURIZING STRAND MATERIAL

(71) Applicant: Owens Corning Intellectual Capital, LLC, Toledo, OH (US)

(72) Inventor: Luc J. Brandt, Henri-Chapelle (BE)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 386 days.

(21) Appl. No.: 16/639,641

(22) PCT Filed: Aug. 14, 2018

(86) PCT No.: PCT/US2018/046687
§ 371 (c)(1),
(2) Date: Feb. 17, 2020

(87) PCT Pub. No.: WO2019/046010
PCT Pub. Date: Mar. 7, 2019

(65) Prior Publication Data

US 2020/0240052 A1 Jul. 30, 2020

(30) Foreign Application Priority Data

Aug. 31, 2017 (EP) ..... 17188863

(51) Int. Cl.
*D02J 1/08* (2006.01)
*D02G 1/16* (2006.01)

(52) U.S. Cl.
CPC ..... *D02J 1/08* (2013.01); *D02G 1/161* (2013.01); *D02G 1/162* (2013.01)

(58) Field of Classification Search
CPC ..... D02G 1/16; D02G 1/161; D02G 1/162; D02G 1/167; D02G 1/164; D02G 1/168; D02J 1/08; D01D 5/22
USPC ..... 28/273
See application file for complete search history.

(56) References Cited

U.S. PATENT DOCUMENTS 3,020,000 A 2/1962 Morgan
3,295,162 A * 1/1967 Forceville ..... D01D 5/20 425/76
3,823,450 A 7/1974 Ankudowicz et al.
3,911,655 A * 10/1975 London, Jr. ..... D02G 1/024 28/271

(Continued)

FOREIGN PATENT DOCUMENTS

CN 85204341 U 6/1986
EP 1010788 A1 6/2000
GB 2098244 A 11/1982

OTHER PUBLICATIONS

Office Action from IN Application No. 202037012036 dated Feb. 23, 2022.

(Continued)

*Primary Examiner* — Amy Vanatta
(74) *Attorney, Agent, or Firm* — Calfee, Halter & Griswold LLP

(57) ABSTRACT

A device for texturizing strand material into a wool-type product includes outer and inner nozzle sections. The outer and inner nozzle sections interface and define a passage through which the strand material travels. At least a portion of the passage has a non-uniform diameter that increases in a direction moving away from an input end of the device.

29 Claims, 15 Drawing Sheets

SECTION B-B

(56) References Cited

U.S. PATENT DOCUMENTS

| | | | | | |
|---|---|---|---|---|---|
| 4,124,924 | A | * | 11/1978 | Phillips | D02G 1/162 28/220 |
| 4,148,116 | A | * | 4/1979 | Price | D02G 1/161 28/273 |
| 4,157,605 | A | * | 6/1979 | Agers | D02G 1/161 28/273 |
| 4,183,123 | A | * | 1/1980 | Tanaka | D02G 1/161 28/273 |
| 4,189,812 | A | | 2/1980 | Agers et al. | |
| 4,476,079 | A | * | 10/1984 | Phillips | D02G 1/165 28/258 |
| 4,569,471 | A | | 2/1986 | Ingemansson et al. | |
| 4,631,791 | A | | 12/1986 | Symon | |
| 5,766,541 | A | | 6/1998 | Knutsson et al. | |
| 5,976,453 | A | | 11/1999 | Nilsson et al. | |
| 6,088,892 | A | * | 7/2000 | Bertsch | D02G 1/161 28/276 |
| 9,963,803 | B2 | | 5/2018 | Brandt | |
| 2006/0064859 | A1 | * | 3/2006 | Bertsch | D02G 1/161 28/271 |
| 2010/0307632 | A1 | | 12/2010 | Nilsson et al. | |
| 2014/0302189 | A1 | | 10/2014 | Brandt | |

OTHER PUBLICATIONS

Extended European Search Report from EP Application No. 17188863.9 dated Jul. 20, 2018.

International Search Report and Written Opinion from PCT/US2018/046687 dated Sep. 19, 2018.

Office Action from RU Application No. 2020111071 dated Nov. 23, 2021.

Office Action from CN Application No. 201880064261.6 dated Oct. 13, 2021.

Office Action from BR Application No. BR112020004095-9 dated Jun. 24, 2022.

Office Action from JP Application No. 2020-512602 dated Jul. 21, 2022.

Office Action from KR Application No. 10-2020-7008200 dated Aug. 31, 2022.

* cited by examiner

SECTION A-A

SECTION B-B

APPARATUS FOR TEXTURIZING STRAND MATERIAL

RELATED APPLICATIONS

This application is the U.S. national stage entry of PCT/US2018/046687, filed on Aug. 14, 2018, which claims priority to and all benefit of European Patent Application No. 17188863.9, filed on Aug. 31, 2017 and titled APPARATUS FOR TEXTURIZING STRAND MATERIAL, the entire disclosures of which are fully incorporated herein by reference.

FIELD

The inventive concepts relate generally to the production of a texturized strand material and, more particularly, to a device for and method of producing the texturized strand material.

BACKGROUND

Devices for expanding a strand material into a wool-type product are known. For example, such a device is disclosed in U.S. Pat. No. 5,976,453 to Nilsson et al. As described in the '453 patent, the device uses a source of compressed air to move the strand material through the device. The source of compressed air is also used to disrupt the integrity of the strand material, which is formed from many (e.g., thousands) of individual fiberglass filaments.

Referring now to FIGS. 1A-1G, a conventional expanding or texturing device 100 for expanding strand material, such as the strand material 20 of the '453 patent, into a wool-type product will be described. The device 100 comprises an outer nozzle section 102 and an internal nozzle section 104. The outer nozzle section 102 has an entrance portion 106, an intermediate portion 108, and an exit portion 110 (see FIG. 1E). The exit portion 110 includes an intermediate nozzle segment 112. The intermediate nozzle segment 112 is integral with the intermediate portion 108 of the outer nozzle section 102 and has a second inner passage 114. The exit portion 110 can receive an outlet tube 116 therein, which is held in place via a set screw 118. The outlet tube 116 has a third inner passage 120. The outlet tube 116 can be coupled to a cutting device (not shown), such as the cutting device 50 of the '453 patent. An outer nozzle segment (not shown) can also be coupled to the cutting device and has a fourth inner passage.

A portion of the internal nozzle section 104 is received in the outer nozzle section 102, as shown in FIG. 1E. A washer 130 is situated between the sections 102 and 104. The internal nozzle section 104 includes a main body portion 132 and a needle portion 134 integral with and extending from the main body portion 132. The main body and needle portions 132 and 134 include a first inner passage 140 through which the strand material passes as it moves through the device 100. The first passage 140 extends from an input opening 142 of the main body portion 132 to an output opening 144 of the needle portion 134.

The main body and needle portions 132 and 134 define, along with inner surfaces 146 and 148 of the entrance and intermediate portions 106 and 108 of the outer nozzle section 102, an inner chamber 150. An outer surface 156 of a terminal end 158 of the needle portion 134 is spaced about 3 mm from the inner surface 148 of the intermediate portion 108 of the outer nozzle section 102 such that a gap $G_1$ exists between the outer surface 156 of the needle portion 134 and the inner surface 148 of the intermediate portion 108 (see FIG. 1F).

The internal nozzle section 104 and the outer nozzle section 102 may be joined together in any suitable manner. For example, fasteners (e.g., screws) can be used to join the sections 102 and 104 to one another. As another example, an outer surface of the main body portion 132 and a portion of the inner surface of the entrance portion 106 of the outer nozzle section 102 could be threaded, such as shown in the '453 patent. In this case, the main body portion 132 may be rotated so as to set the gap $G_1$ between the outer surface 156 of the needle portion 134 and the inner surface 148 of the intermediate portion 108.

The outer surface 156 of the terminal end 158 of the needle portion 134 has a conical shape and extends at an angle of about 60 degrees to a longitudinal axis z of the needle portion 134. Similarly, the intermediate portion 108 of the outer nozzle section 102 has a conical shape and extends at an angle of about 60 degrees to the longitudinal axis z.

The device 100 includes an opening 160 for interfacing with a gas stream source (not shown), such as an air compressor. In this manner, pressurized gas flows from the gas stream source, through the opening 160, and into the chamber 150. The pressurized gas exerts tension or "pulls" on the strand material as it is fed through the first passage 140, the second passage 114, the third passage 120, and the fourth passage toward a distal end of the device 100. It also separates and entangles the fibers of the strand material so that the strand material emerges from the distal end of the device 100 and becomes a "fluffed-up" material or wool-type product.

The gas stream source could also provide pressurized gas to other portions of the device 100, such as the aforementioned cutting device or to a locking device 170 (see FIGS. 1E-1G). The locking device 170 selectively halts movement of the strand material through the device 100. In the embodiment shown in FIGS. 1A-1G, the locking device 170 includes a piston 172 that can move within a cavity 174 between a first position corresponding to an unlocked state and a second position corresponding to a locked state. In the unlocked state, an end of the piston 172 is within the cavity 174 and does not impinge on any strand material in the first passage 140. Conversely, in the locked state, the end of the piston 172 is pushed down (via application of the pressurized gas) so that it exits the cavity 174, passes through a channel 176, and enters the first passage 140 where it presses on the strand material in the first passage 140, effectively preventing movement of the strand material.

As noted above, the pressurized gas introduced into the chamber 150 causes the strand material to move through the device 100 and disrupts the integrity of the strand material so that the individual filaments forming the strand material are separated from one another. The disruption of the strand integrity is a necessary precursor to texturization of the strand material. However, a negative consequence of the pressurized gas impacting the strand material is that some of the filaments forming the strand material are broken and become separated from the strand material. Surprisingly, at least a portion of these broken filaments tend to collect within the device 100 (e.g., near the input opening 142 of the main body portion 132), as opposed to being blown through and out of the device 100 by the pressurized gas. Furthermore, these broken filaments can undesirably migrate into the cavity 174 of the locking device 170.

It has been discovered that the particular shape and/or size of various air flow passages within the device 100 contribute to this problem. With respect to the device 100, these air flow passages include at least one or more of the first passage 140, the second passage 114, the third passage 120, and the gap $G_1$.

The first passage 140 extends from the input opening 142 of the main body portion 132 to the output opening 144 of the needle portion 134 and includes a first portion 180 having a first diameter $D_1$ and a second portion 182 having a second diameter $D_2$, where $D_2>D_1$. The first diameter $D_1$ is 4 mm, while the second diameter $D_2$ is 5 mm. The transition from the second portion 182 (i.e., $D_2$) to the first portion 180 (i.e., $D_1$) occurs somewhere between the output opening 144 of the needle portion 134 and a central axis x of the piston 172. Furthermore, a region 178 where the channel 176 meets the first passage 140 forms an angle of 90 degrees.

The second passage 114 extends from the output opening 144 of the needle portion 134 to the third passage 120 and has a third diameter $D_3$. The third diameter $D_3$ is uniform along the length of the second passage 114. The third diameter $D_3$ is 8 mm.

The third passage 120 extends a length of the outlet tube 116 and has a fourth diameter $D_4$. The fourth diameter $D_4$ is uniform along the length of the third passage 120. The fourth diameter $D_4$ is 8 mm.

The input opening 142 of the main body portion 132 has a fifth diameter $D_5$ that gradually transitions to the second diameter $D_2$ within the first passage 140 (i.e., before reaching the channel 176). The fifth diameter $D_5$ is 25 mm. As noted above, the second diameter $D_2$ is 5 mm.

The gap $G_1$ that exists between the outer surface 156 of the needle portion 134 and the inner surface 148 of the intermediate portion 108 is substantially uniform within the device 100. A horizontal measurement of the gap $G_1$ is 3 mm.

Texturized products produced by the device 100 can be used as acoustic and/or thermal insulation in automotive and industrial applications. However, there is an unmet need for an improved expanding/texturizing device that can produce such texturized products, while reducing or otherwise eliminating the drawbacks noted above that impair the efficiency and/or reliability of conventional devices.

SUMMARY

The general inventive concepts relate generally to the production of a texturized strand material and, more particularly, to a device for and method of producing the texturized strand material.

In an exemplary embodiment, a device for texturizing a strand material is provided. The device comprises a nozzle body and a passage extending through the nozzle body. The passage extends from a first end of the nozzle body to a second end of the nozzle body The passage is sized to allow a strand material to pass therethrough, wherein the strand material enters the nozzle body at the first end and exits the nozzle body at the second end. In the device, a pressurized gas impinges on the strand material within the passage. The device is characterized by the passage having a first portion with a length $l_1$ and a non-uniform diameter $d_1$ over the length $l_1$, the diameter $d_1$ increasing in a direction moving toward the second end of the nozzle body.

In an exemplary embodiment, the length $l_1$ is between 10 mm and 12 mm. In an exemplary embodiment, the length $l_1$ is 11 mm.

In an exemplary embodiment, the diameter $d_1$ increases from 7 mm to 11 mm over the length $l_1$. In an exemplary embodiment, the diameter $d_1$ increases from 8 mm to 10 mm over the length $l_1$.

In an exemplary embodiment, the device is further characterized by the passage having a second portion with a length $l_2$ and a uniform diameter $d_2$ over the length $l_2$, wherein the second portion is adjacent to the first portion, and wherein the second portion is closer to the first end of the nozzle body than the first portion.

In an exemplary embodiment, the length $l_2$ is between 4 mm and 6 mm. In an exemplary embodiment, the length $l_2$ is 5 mm.

In an exemplary embodiment, the diameter $d_2$ is between 7 mm and 9 mm. In an exemplary embodiment, the diameter $d_2$ is 8 mm.

In an alternative exemplary embodiment, the diameter $d_1$ is uniform across the length $l_1$, the diameter $d_2$ is uniform across the length $l_2$, and the diameter $d_1$ is larger than the diameter $d_2$.

In an exemplary embodiment, the pressurized gas first impinges on the strand material within the second portion of the passage.

In an exemplary embodiment, the device further comprises a locking device. The locking device is operable to be selectively placed in one of a first state and a second state. The first state corresponds to the locking device being engaged to prevent movement of the strand material within the passage. The second state corresponds to the locking device being disengaged to allow movement of the strand material within the passage. The locking device includes a piston and a spring disposed within a cavity, wherein a seal holder is disposed within the cavity to fix a sealing member within the cavity, and wherein the sealing member at least partially prevents debris from entering the cavity from the passage.

In an exemplary embodiment, the cavity is connected to the passage by a channel, wherein the channel is sized to allow a portion of the piston to exit the cavity and enter the passage, and wherein at least a portion of the interface between the channel and the passage has an arcuate shape.

In an exemplary embodiment, the device is further characterized by the passage having a third portion with a length $l_3$ and a uniform dimeter $d_3$ over the length $l_3$, wherein the third portion extends between the second portion and the channel.

In an exemplary embodiment, the length $l_3$ is between 70 mm and 75 mm. In an exemplary embodiment, the length $l_3$ is 72.4 mm.

In an exemplary embodiment, the diameter $d_3$ is between 2 mm and 5 mm. In an exemplary embodiment, the diameter $d_3$ is 3 mm. In an exemplary embodiment, the diameter $d_3$ is 4 mm.

In an exemplary embodiment, the device is further characterized by the passage having a fourth portion with a length $l_4$ and a non-uniform diameter $d_4$ over the length $l_4$, the diameter $d_4$ increasing in a direction moving toward the first end of the nozzle body, wherein the fourth portion extends between the channel and the first end of the nozzle body.

In an exemplary embodiment, the length $l_4$ is between 8 mm and 12 mm. In an exemplary embodiment, the length $l_4$ is 10 mm.

In an exemplary embodiment, the diameter $d_4$ increases from 4 mm to 26 mm over the length $l_4$. In an exemplary embodiment, the diameter $d_4$ increases from 5 mm to 25 mm over the length $l_4$.

In an exemplary embodiment, the device is further characterized by the passage having a fifth portion with a length $l_5$ and a uniform diameter $d_5$ over the length $l_5$, wherein the fifth portion extends between the first portion and the second end of the nozzle body.

In an exemplary embodiment, the length $l_5$ is between 5 mm and 20 mm. In an exemplary embodiment, the length $l_5$ is 13.5 mm.

In an exemplary embodiment, the diameter $d_5$ is between 9 mm and 15 mm. In an exemplary embodiment, the diameter $d_5$ is 12 mm.

In an exemplary embodiment, the device further comprises an outlet tube. An outer diameter of the outlet tube is sized such that at least a portion of the outlet tube fits within the fifth portion. An inner diameter of the outlet tube corresponds to the largest value of the diameter $d_1$. In some exemplary embodiments, the inner diameter of the outlet tube is 10 mm.

The outlet tube is removably attached to the nozzle body. The strand material is operable to pass through the outlet tube before exiting the device. In an exemplary embodiment, the outlet tube is secured to the nozzle body by a set screw extending through a threaded hole in the nozzle body. In an exemplary embodiment, the outlet tube is harder than the nozzle body.

In an exemplary embodiment, the device is further characterized by the nozzle body including an outer nozzle section and an inner nozzle section. The outer nozzle section includes a sloped intermediate portion. The inner nozzle section includes a sloped needle portion. At least a portion of the inner nozzle section is positioned within the outer nozzle section such that a conical gap $G_2$ exists between an inner surface of the sloped intermediate portion and an outer surface of the sloped needle portion, wherein the pressurized gas flows from a chamber within the nozzle body through the gap $G_2$ before impinging on the strand material within the passage.

In an exemplary embodiment, a horizontal distance of the gap $G_2$ is between 1.5 mm and 1.9 mm.

In an exemplary embodiment, the strand material is a continuous glass fiber strand.

In an exemplary embodiment, the pressurized fluid is compressed air.

In an exemplary embodiment, the device further comprises a cutting device, wherein the cutting device is operable to sever the strand material.

In other exemplary embodiments, the device for texturizing a strand material includes a nozzle body and a passage extending through the nozzle body, wherein the passage includes the aforementioned first portion and one or more of the second portion, the third portion, the fourth portion, the fifth portion, and the gap $G_2$.

In other exemplary embodiments, the device for texturizing a strand material includes a nozzle body and a passage extending through the nozzle body, wherein the passage includes the aforementioned first portion and two or more of the second portion, the third portion, the fourth portion, the fifth portion, and the gap $G_2$.

In other exemplary embodiments, the device for texturizing a strand material includes a nozzle body and a passage extending through the nozzle body, wherein the passage includes the aforementioned first portion at least three of the second portion, the third portion, the fourth portion, the fifth portion, and the gap $G_2$.

In other exemplary embodiments, the device for texturizing a strand material includes a nozzle body and a passage extending through the nozzle body, wherein the passage includes two or more of the first portion, the second portion, the third portion, the fourth portion, the fifth portion, and the gap $G_2$.

In other exemplary embodiments, the device for texturizing a strand material includes a nozzle body and a passage extending through the nozzle body, wherein the passage includes at least three of the first portion, the second portion, the third portion, the fourth portion, the fifth portion, and the gap $G_2$.

Other aspects, advantages, and features of the general inventive concepts will become apparent to those skilled in the art from the following detailed description, when read in light of the accompanying drawings.

BRIEF DESCRIPTION OF THE DRAWINGS

For a fuller understanding of the nature and advantages of the general inventive concepts, reference should be had to the following detailed description taken in connection with the accompanying drawings, in which:

FIG. 1A is an upper perspective view of the texturizing apparatus. FIG. 1B is a front elevational view of the texturizing apparatus. FIG. 1C is a rear elevational view of the texturizing apparatus. FIG. 1D is a top plan view of the texturizing apparatus. FIG. 1E is a cross-sectional, side elevational view of the texturizing apparatus, taken along line A-A of FIG. 1C. FIG. 1F shows two detailed views (i.e., Detail A and Detail B) of the texturizing apparatus of FIG. 1E. FIG. 1G shows a detailed view (i.e., Detail C) of the texturizing apparatus of FIG. 1E.

FIG. 2A is an upper perspective view of the texturizing apparatus. FIG. 2B is a front elevational view of the texturizing apparatus. FIG. 2C is a rear elevational view of the texturizing apparatus. FIG. 2D is a top plan view of the texturizing apparatus. FIG. 2E is a cross-sectional, side elevational view of the texturizing apparatus, taken along line B-B of FIG. 2C. FIG. 2F shows two detailed views (i.e., Detail D and Detail E) of the texturizing apparatus of FIG. 2E. FIG. 2G shows a detailed view (i.e., Detail F) of the texturizing apparatus of FIG. 2E. FIG. 2H shows a detailed view (i.e., Detail G) of the texturizing apparatus of FIG. 2E.

DETAILED DESCRIPTION

Figure 1A:
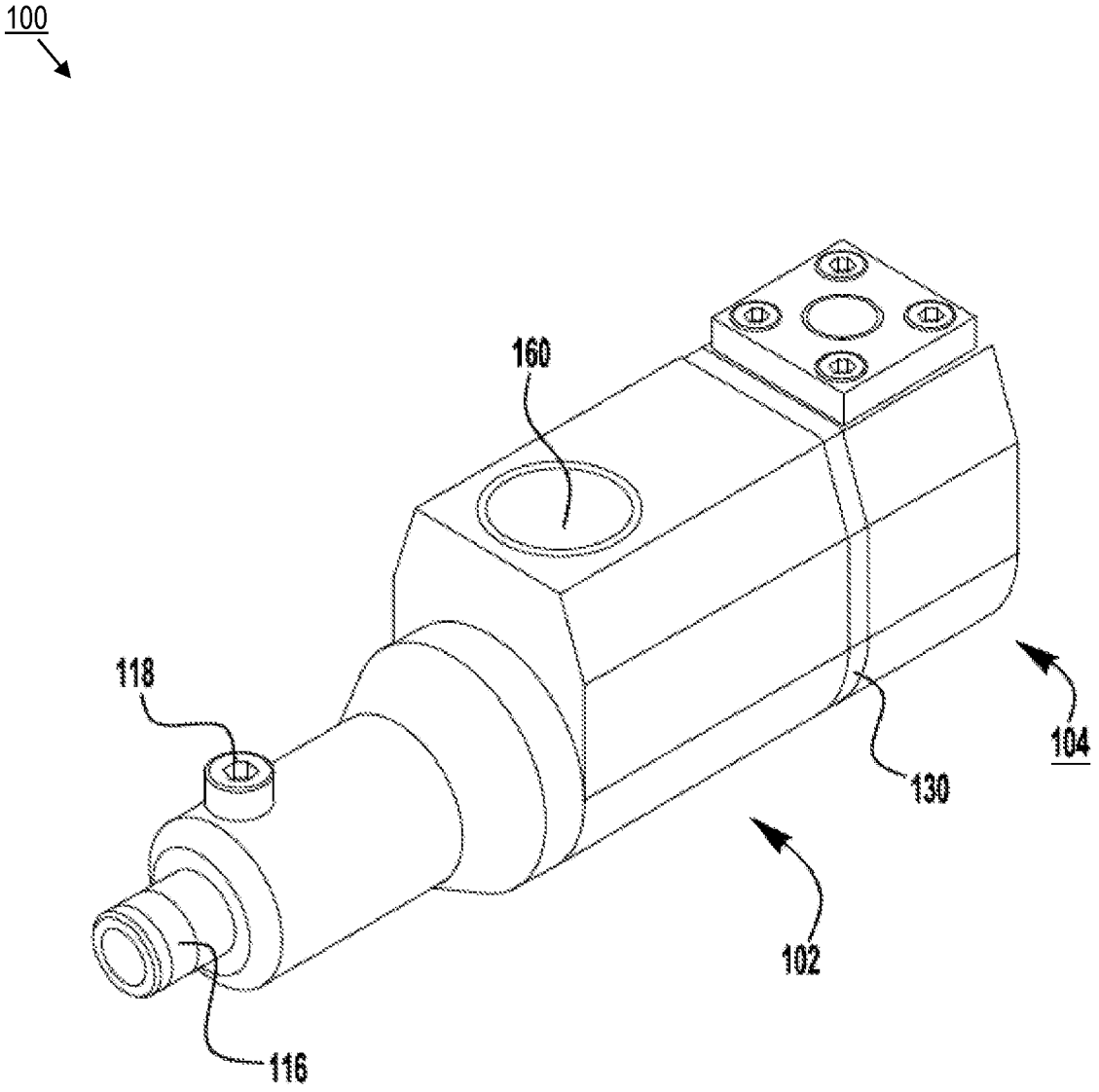
FIG. 1A PRIOR ART
FIGS. 1A-1G illustrate relevant portions of a conventional texturizing apparatus.
Figure 1B:
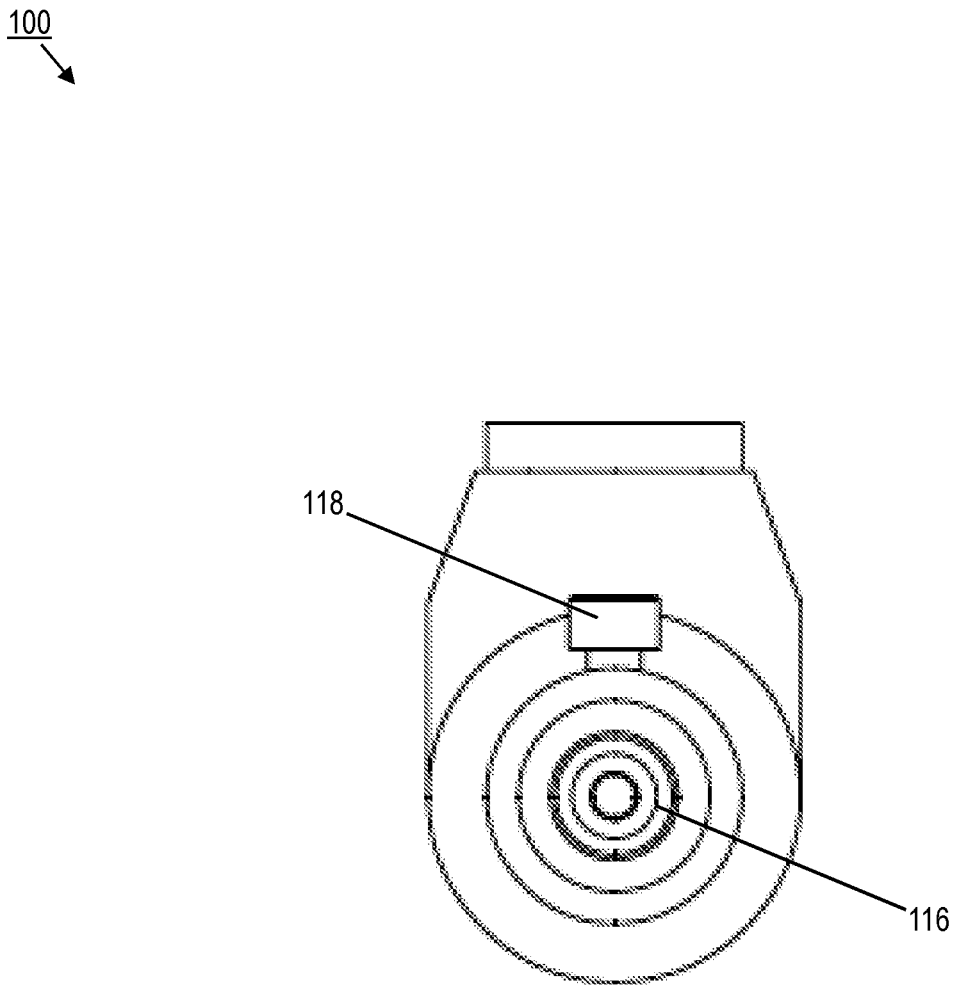
FIG. 1B PRIOR ART
Figure 1C:
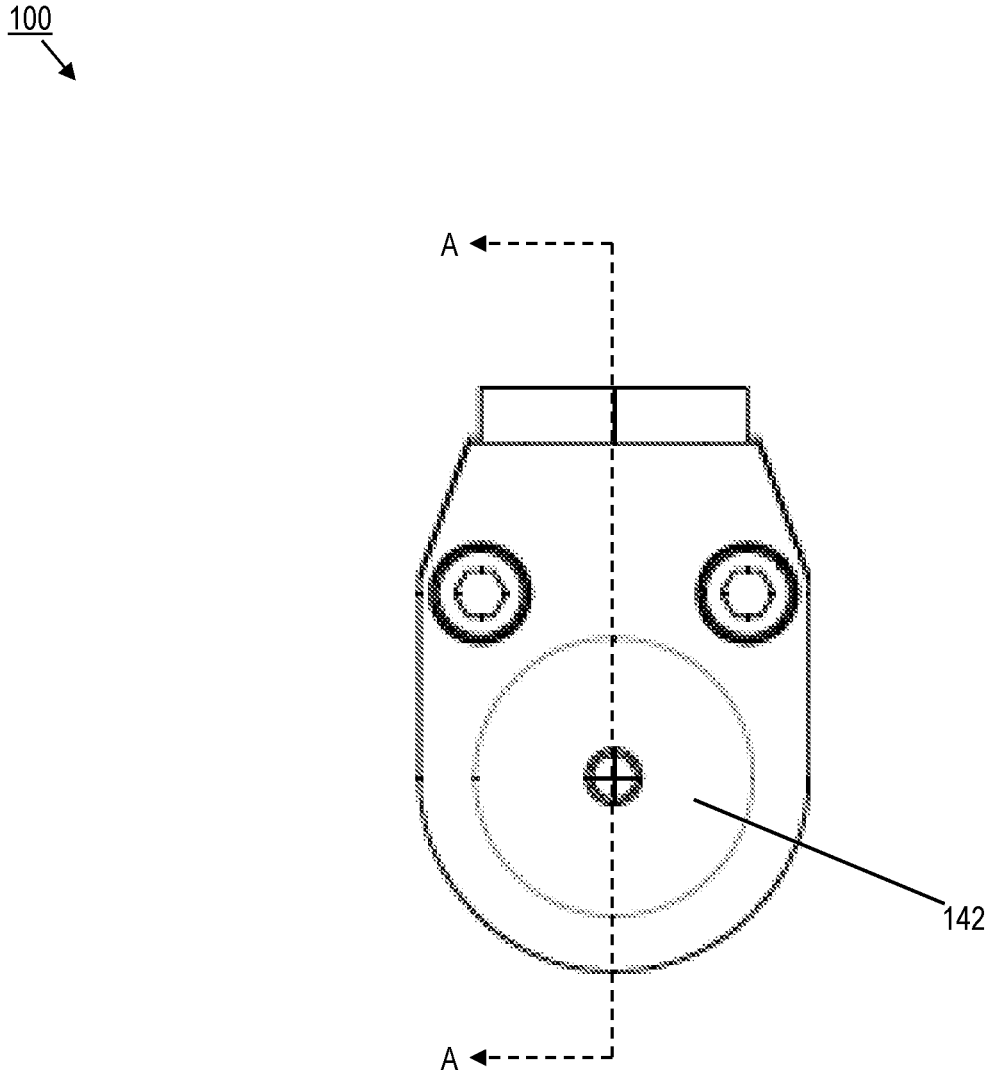
FIG. 1C PRIOR ART
Figure 1D:
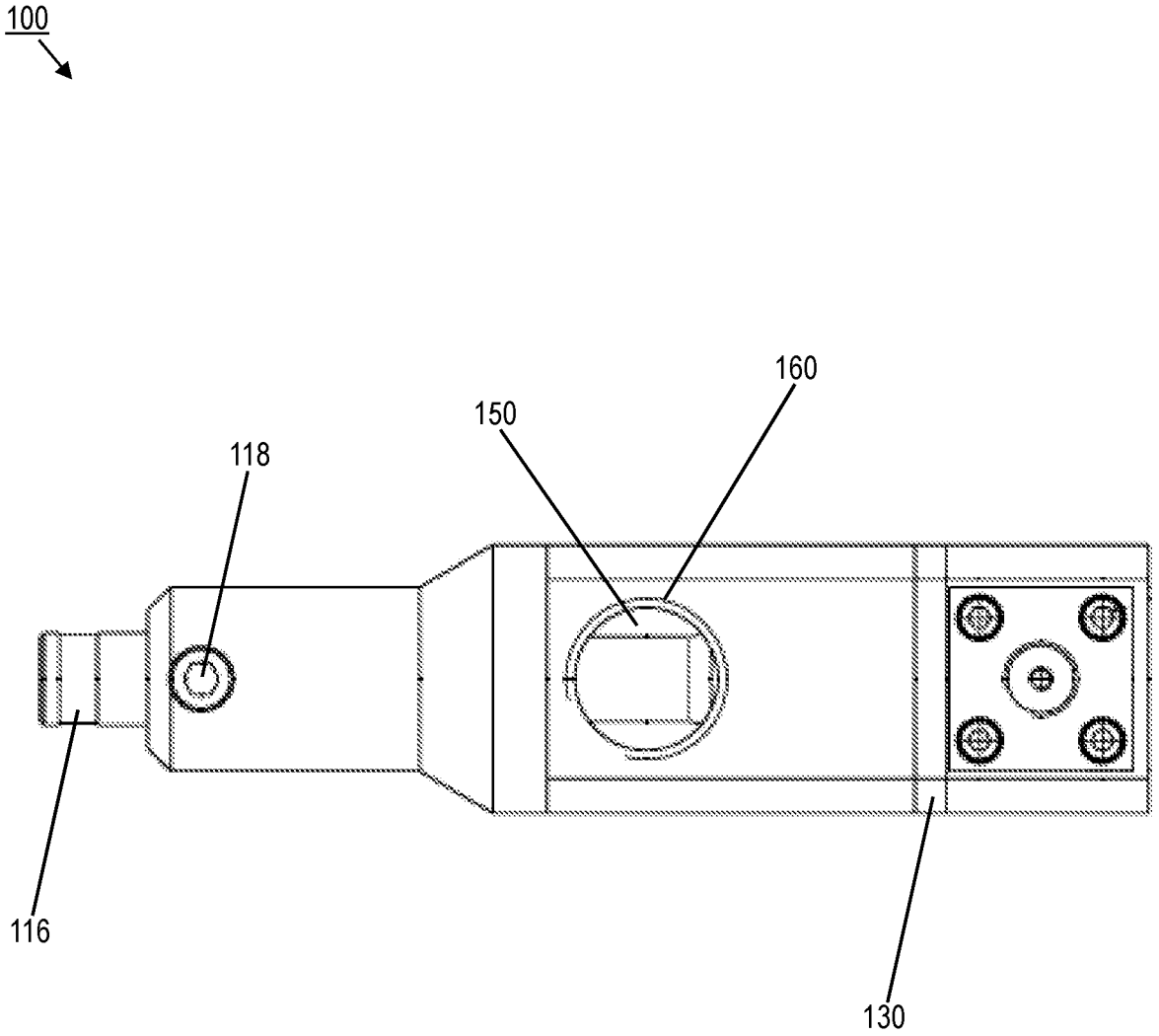
FIG. 1D PRIOR ART
Figure 1E:
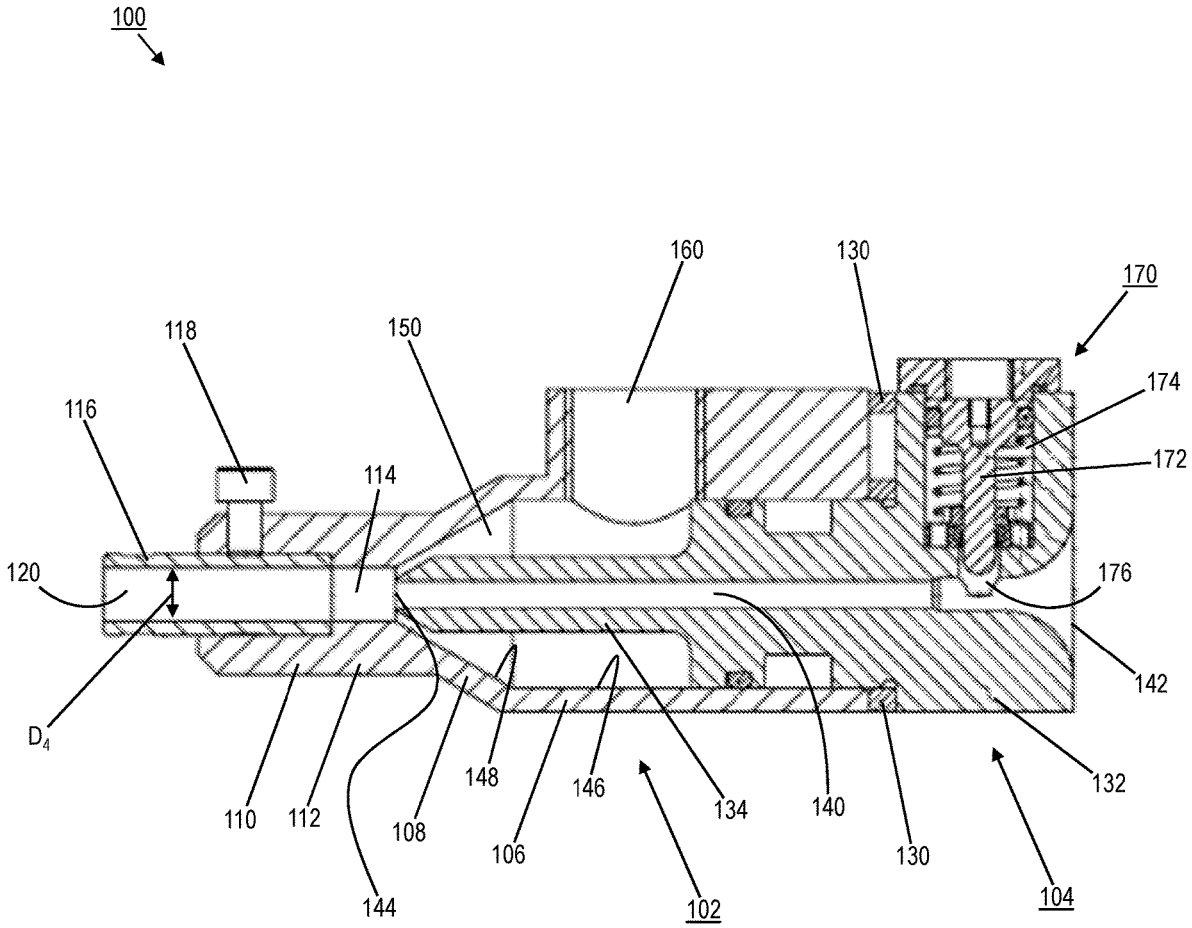
FIG. 1E PRIOR ART
Figure 1F:
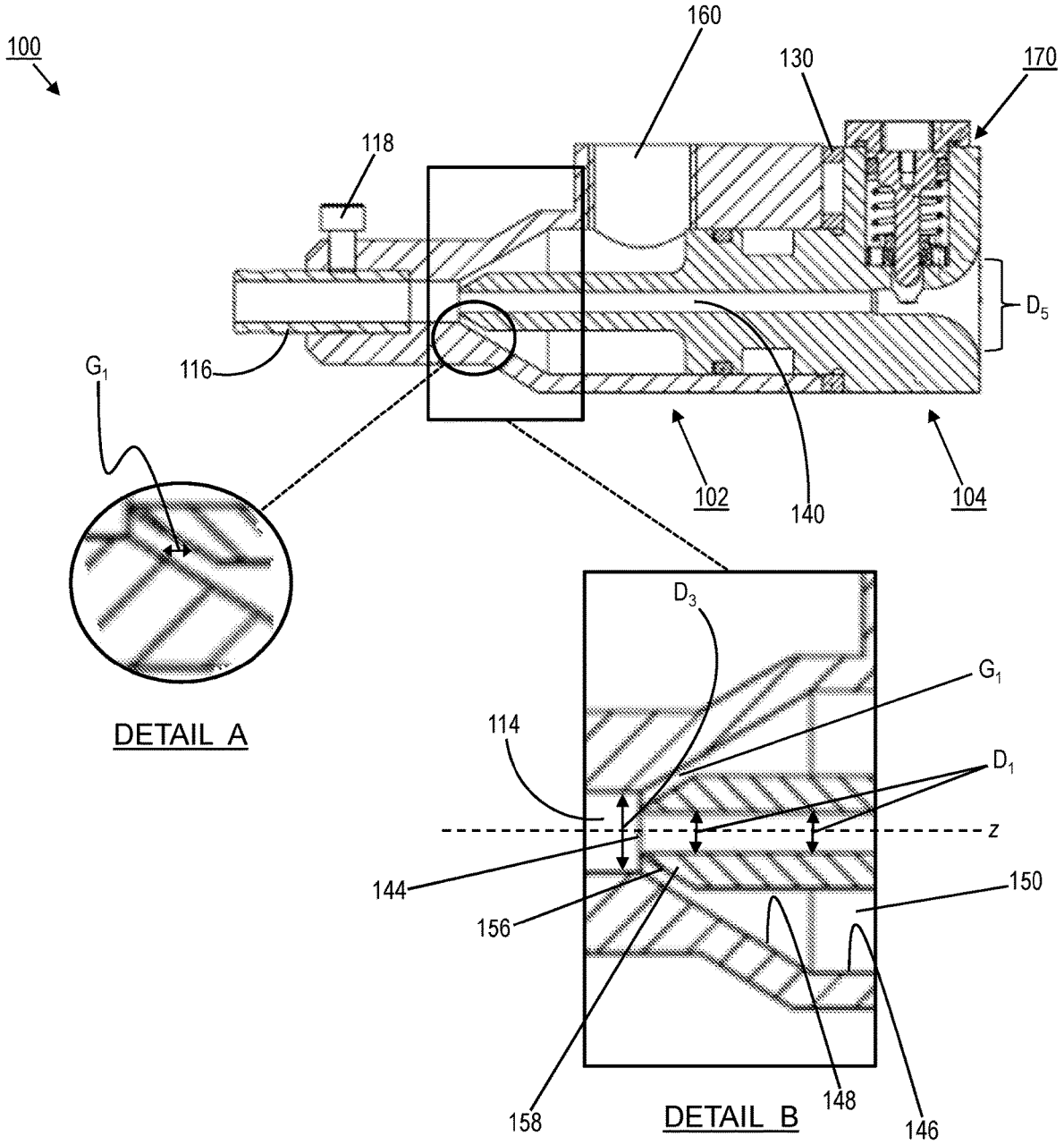
FIG. 1F PRIOR ART
Figure 1G:
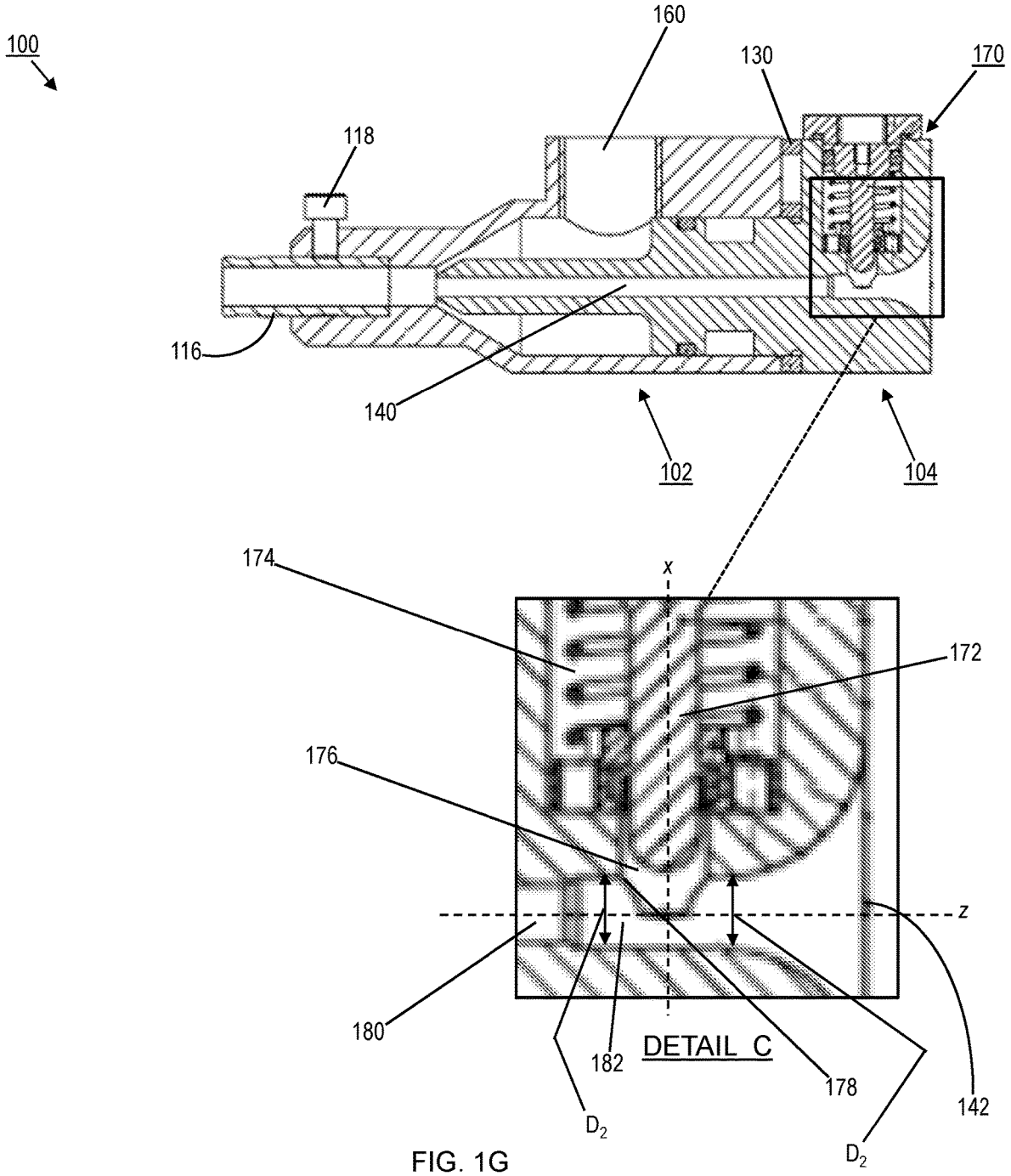
FIG. 1G PRIOR ART

While the general inventive concepts are susceptible of embodiment in many different forms, there are shown in the drawings and will be described herein in detail various exemplary embodiments thereof with the understanding that the present disclosure is to be considered as an exemplification of the principles of the general inventive concepts. Accordingly, the general inventive concepts are not intended to be limited to the specific embodiments illustrated herein.

Unless otherwise defined, the terms used herein have the same meaning as commonly understood by one of ordinary skill in the art encompassing the general inventive concepts. The terminology used herein is for describing exemplary embodiments of the general inventive concepts only and is not intended to be limiting of the general inventive concepts. As used in the description of the general inventive concepts and the appended claims, the singular forms "a," "an," and "the" are intended to include the plural forms as well, unless the context clearly indicates otherwise.

The inventive concepts provide an improved device for and method of producing a texturized strand material.

Referring now to FIGS. 2A-2H, an exemplary device 200 for expanding strand material, such as the strand material 20 of the '453 patent, into a wool-type product will be described. Only those portions of the device 200 relevant to an understanding of the invention will be shown and described. The device 200 comprises an outer nozzle section 202 and an internal nozzle section 204. The outer nozzle section 202 has an entrance portion 206, an intermediate portion 208, and an exit portion 210 (see FIG. 2E). The exit portion 210 includes an intermediate nozzle segment 212. The intermediate nozzle segment 212 is integral with the intermediate portion 208 of the outer nozzle section 202 and has a second inner passage 214. The exit portion 210 includes a cavity 216 that can receive an outlet tube (not shown) therein. The outlet tube is held in place via a set screw (not shown) threaded through a hole 218 in the outer nozzle section 202. The outlet tube has a third inner passage. The outlet tube can be coupled to a cutting device (not shown), such as the cutting device 50 of the '453 patent. An outer nozzle segment (not shown) can also be coupled to the cutting device and has a fourth inner passage.

Figure 2A:
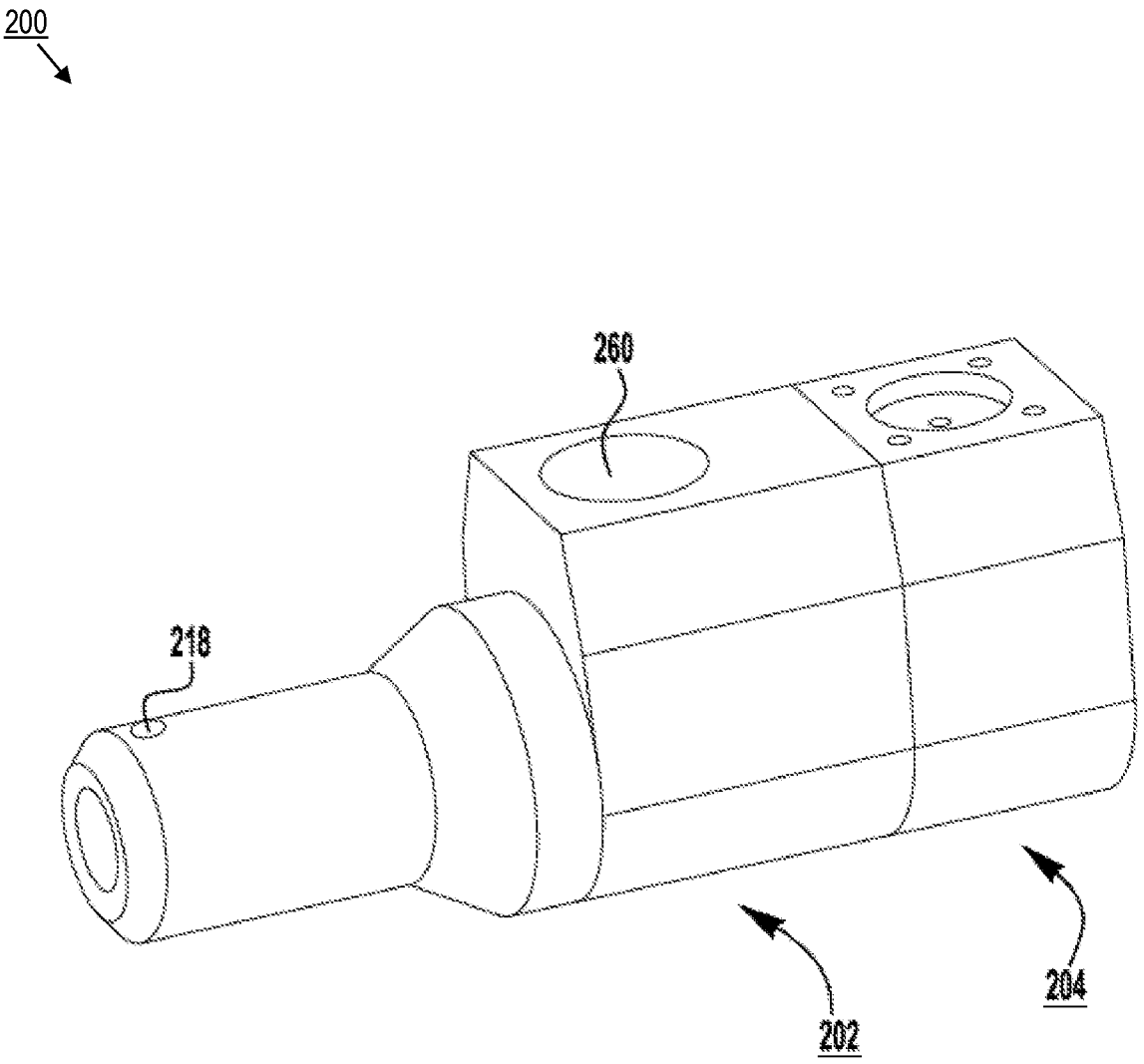
FIGS. 2A-2H illustrate relevant portions of a texturizing apparatus, according to an exemplary embodiment of the invention.
Figure 2B:
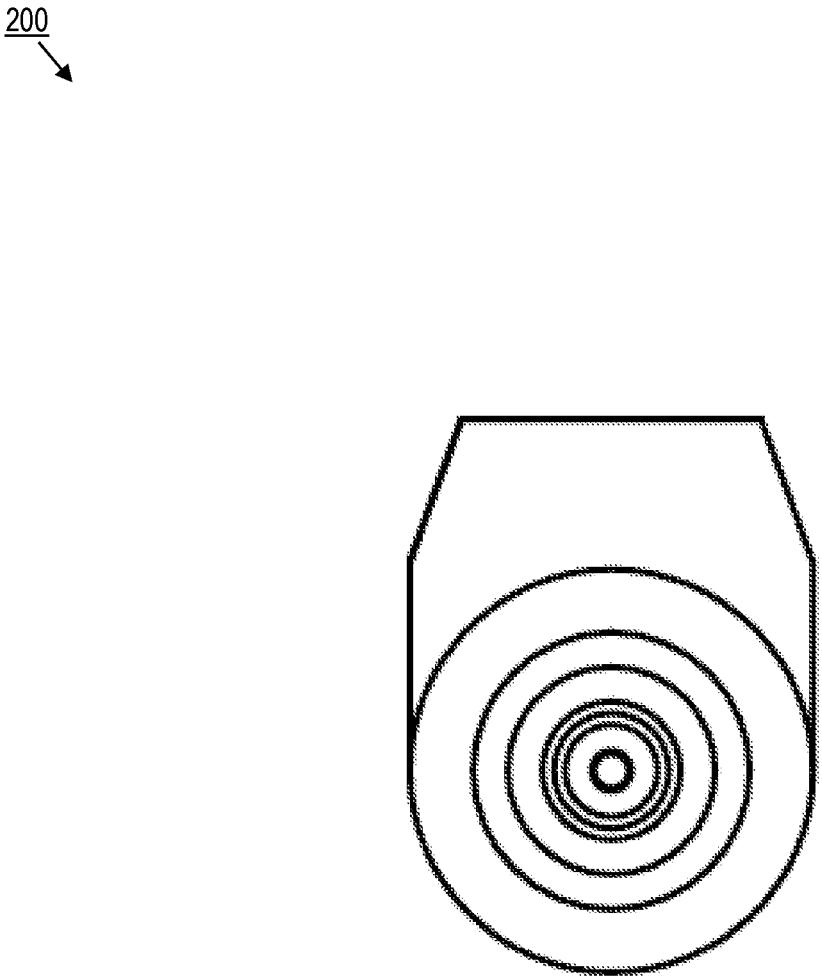
Figure 2C:
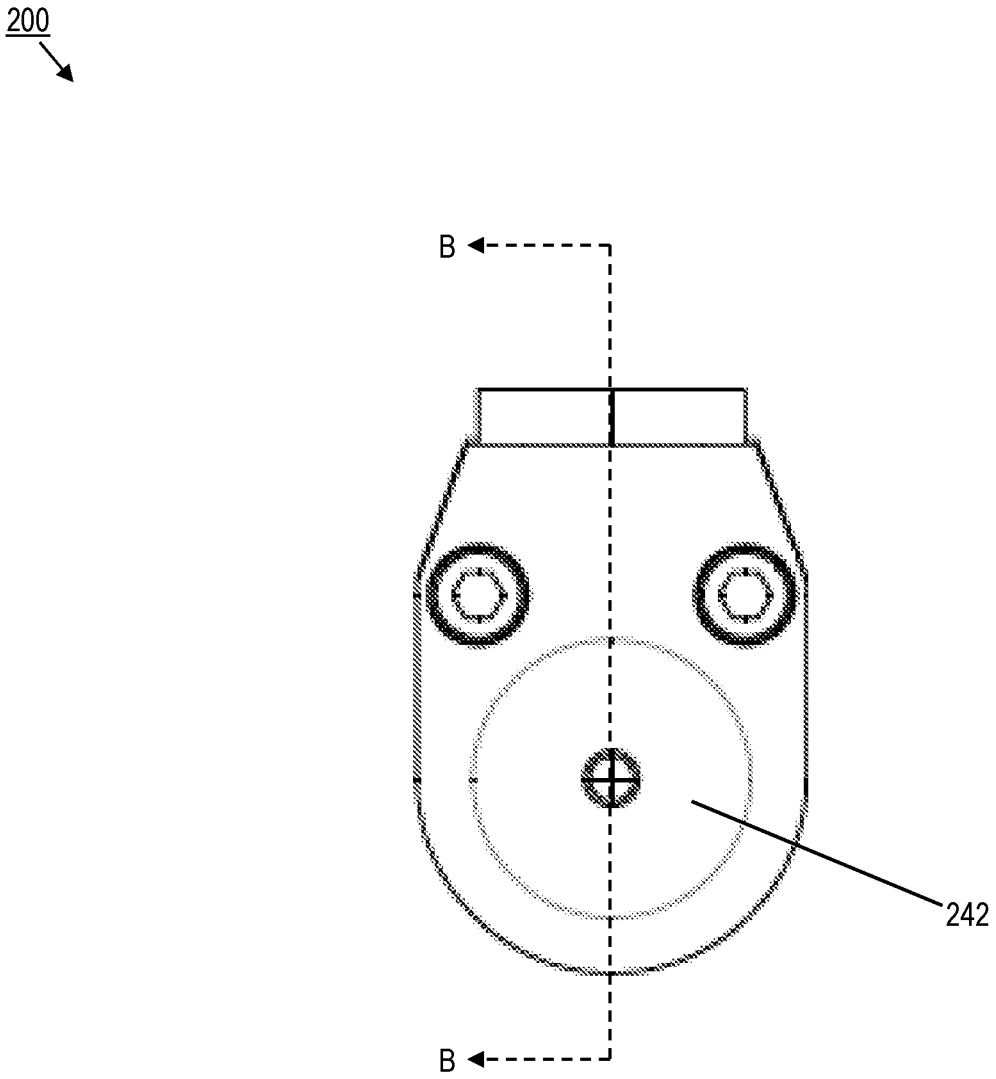
Figure 2D:
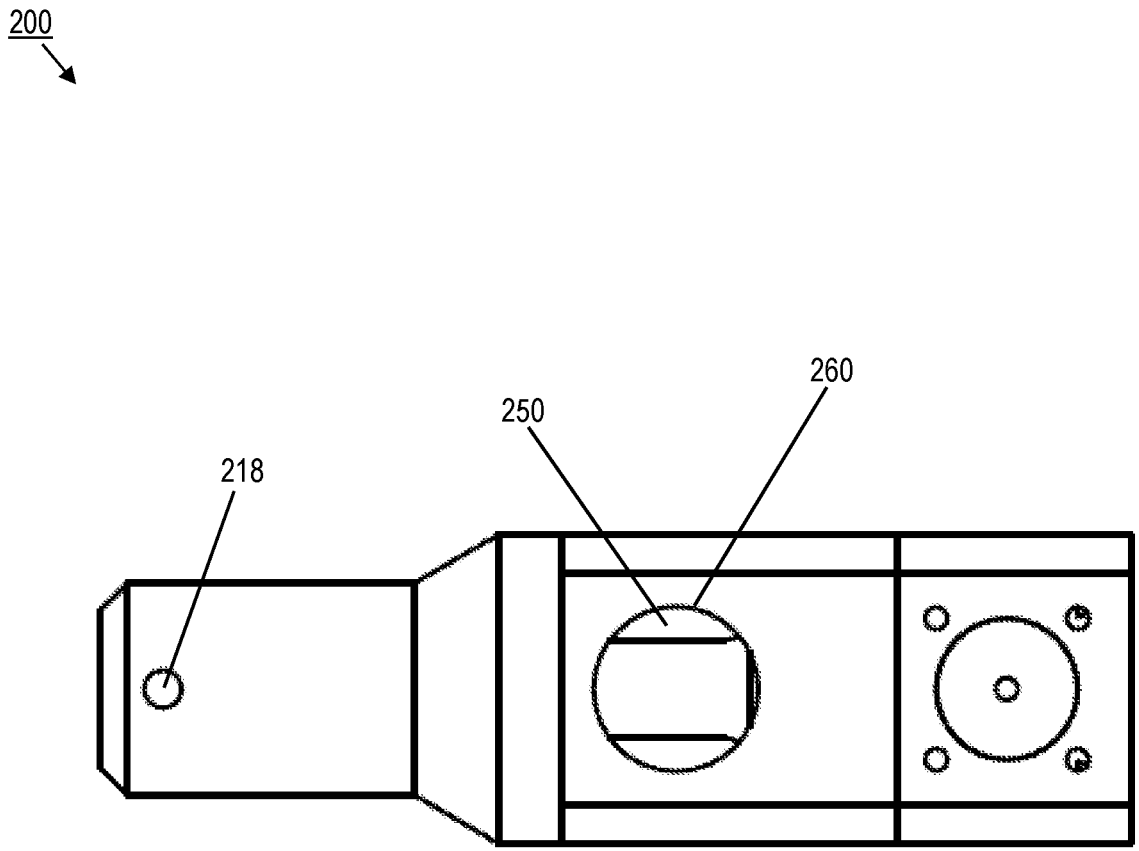
Figure 2E:
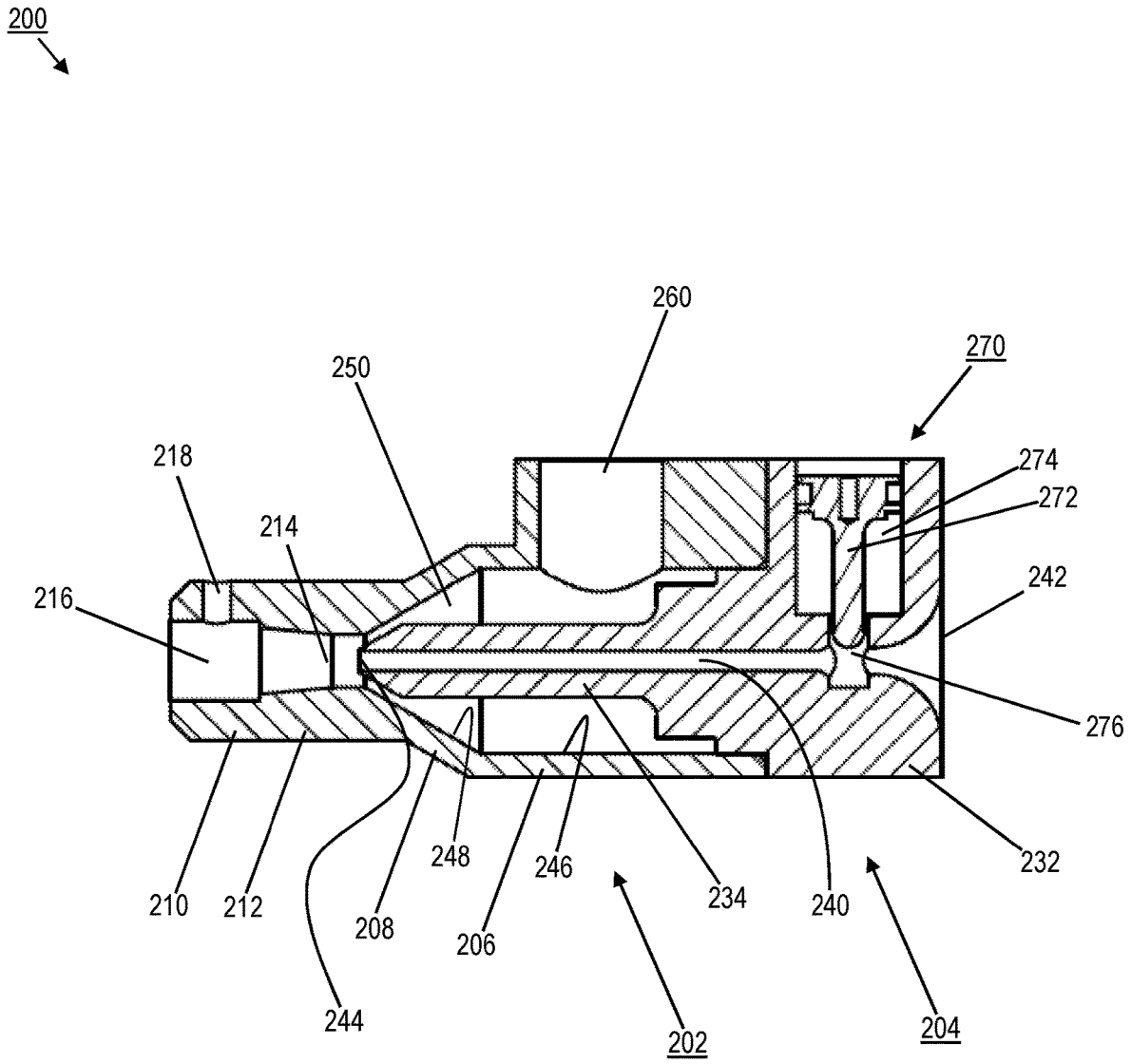

A portion of the internal nozzle section 204 is received in the outer nozzle section 202, as shown in FIG. 2E. The internal nozzle section 204 includes a main body portion 232 and a needle portion 234 integral with and extending from the main body portion 232. The main body and needle portions 232 and 234 include a first inner passage 240 through which the strand material passes as it moves through the device 200. The first passage 240 extends from an input opening 242 of the main body portion 232 to an output opening 244 of the needle portion 234.

The main body and needle portions 232 and 234 define, along with inner surfaces 246 and 248 of the entrance and intermediate portions 206 and 208 of the outer nozzle section 202, an inner chamber 250. An outer surface 256 of a terminal end 258 of the needle portion 234 is spaced apart from the inner surface 248 of the intermediate portion 208 of the outer nozzle section 202 such that a gap $G_2$ exists between the outer surface 256 of the needle portion 234 and the inner surface 248 of the intermediate portion 208 (see FIG. 2F).

The internal nozzle section 204 and the outer nozzle section 202 may be joined together in any suitable manner. For example, fasteners (e.g., screws) can be used to join the sections 202 and 204 to one another. As another example, an outer surface of the main body portion 232 and a portion of the inner surface of the entrance portion 206 of the outer nozzle section 202 could be threaded, such as shown in the '453 patent. In this case, the main body portion 232 may be rotated so as to set the gap $G_2$ between the outer surface 256 of the needle portion 234 and the inner surface 248 of the intermediate portion 208.

The outer surface 256 of the terminal end 258 of the needle portion 234 has a conical shape and extends at an angle of about 60 degrees to a longitudinal axis z of the needle portion 234. Similarly, the intermediate portion 208 of the outer nozzle section 202 has a conical shape and extends at an angle of about 60 degrees to the longitudinal axis z.

The device 200 includes an opening 260 for interfacing with a gas stream source (not shown), such as an air compressor. In this manner, pressurized gas flows from the gas stream source, through the opening 260, and into the chamber 250. The pressurized gas exerts pressure or "pulls" on the strand material as it passes through the first passage 240, the second passage 214, the third passage, and the fourth passage toward a distal end of the device 200. It also separates and entangles the fibers of the strand material so that the strand material emerges from the distal end of the device 200 and becomes a "fluffed-up" material or wool-type product.

The gas stream source could also provide pressurized gas to other portions of the device 200, such as the aforementioned cutting device or to a locking device 270 (see FIGS. 2E-2H). The locking device 270 selectively halts movement of the strand material through the device 200. In the embodiment shown in FIGS. 2A-2H, the locking device 270 includes a piston 272 that can move within a cavity 274 between a first position corresponding to an unlocked state and a second position corresponding to a locked state. In the unlocked state, an end of the piston 272 is within the cavity 274 and does not impinge on any strand material in the first passage 240. Conversely, in the locked state, the end of the piston 272 is pushed down (via application of the pressurized gas) so that it exits the cavity 274, passes through a channel 276, and enters the first passage 240 where it presses on the strand material in the first passage 240, effectively preventing movement of the strand material.

The pressurized gas introduced into the chamber 250 causes the strand material to move through the device 200 and disrupts the integrity of the strand material so that the individual filaments forming the strand material are separated from one another. The disruption of the strand integrity is a necessary precursor to texturization of the strand material. However, as noted above, a negative consequence of the pressurized gas impacting the strand material is that some of the filaments forming the strand material are broken and become separated from the strand material. In conventional expanding/texturizing devices (e.g., the device 100), at least a portion of these broken filaments can collect within the device and degrade its efficiency, for example, requiring more frequent maintenance of the device.

In the device 200, features of various air flow passages are modified to eliminate or otherwise reduce this problem. With respect to the device 200, these air flow passages include at least one or more of the first passage 240, the second passage 214, and the gap $G_2$.

The first passage 240 extends from the input opening 242 of the main body portion 232 to the output opening 244 of the needle portion 234. In the device 200, the first passage 240 includes a portion 241 having a sixth diameter $D_6$ that is uniform between the output opening 244 of the needle portion 234 and a region 278 where the channel 276 meets the first passage 240, i.e., a length $L_3$ (see FIG. 2G). The sixth diameter $D_6$ can be any size suitable to accommodate passage of the strand material therethrough. Typically, the sixth diameter $D_6$ will be only slightly larger than a diameter of the strand material. In this manner, abrasion of the strand material within the first passage 240 is minimized, while also avoiding backflow of the pressurized gas through the first passage 240. In some exemplary embodiments, the sixth diameter $D_6$ is between 2 mm and 5 mm. In some exemplary embodiments, the sixth diameter $D_6$ is 3 mm. In some exemplary embodiments, the sixth diameter $D_6$ is 4 mm.

Figure 2F:
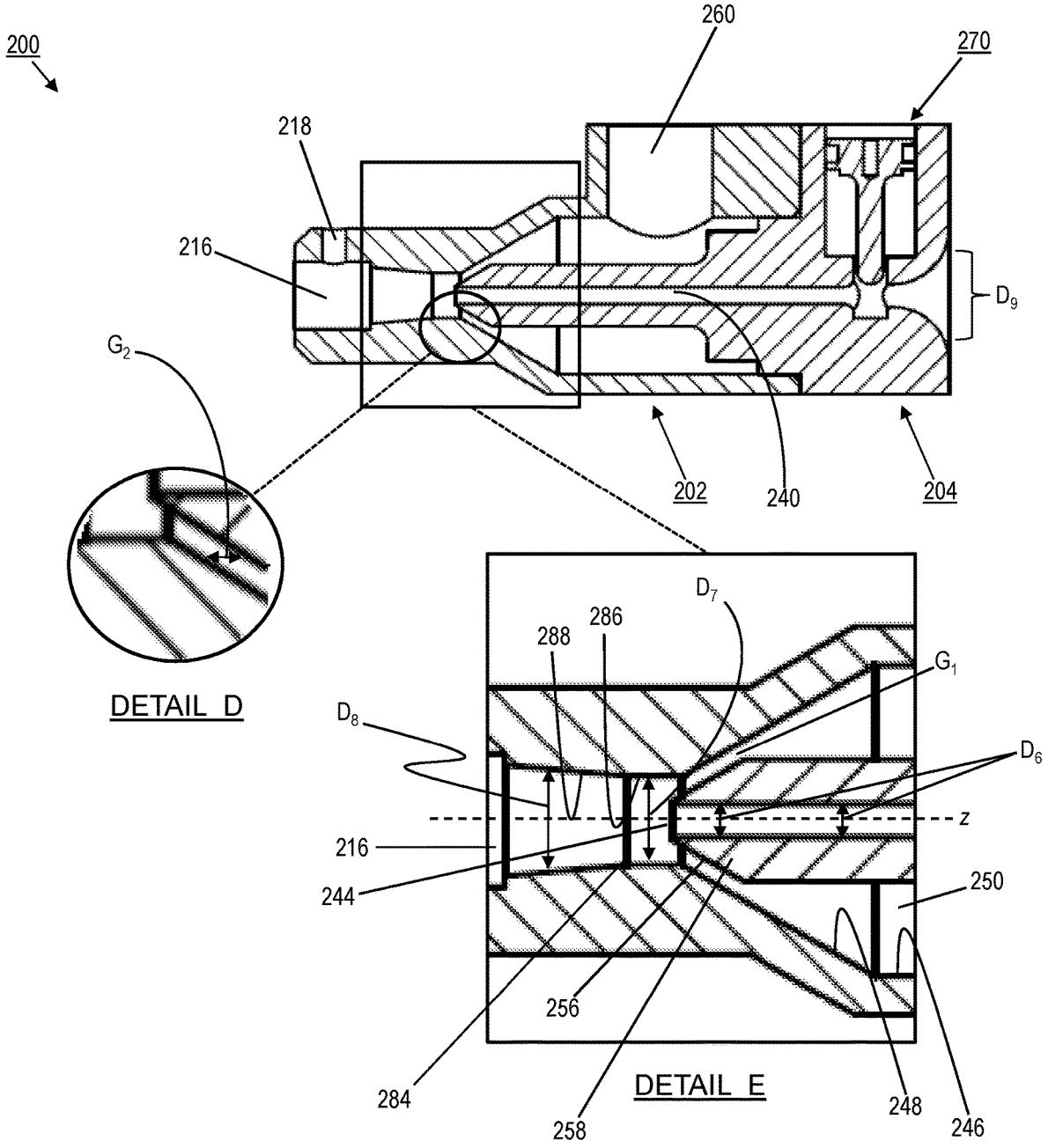
Figure 2G:
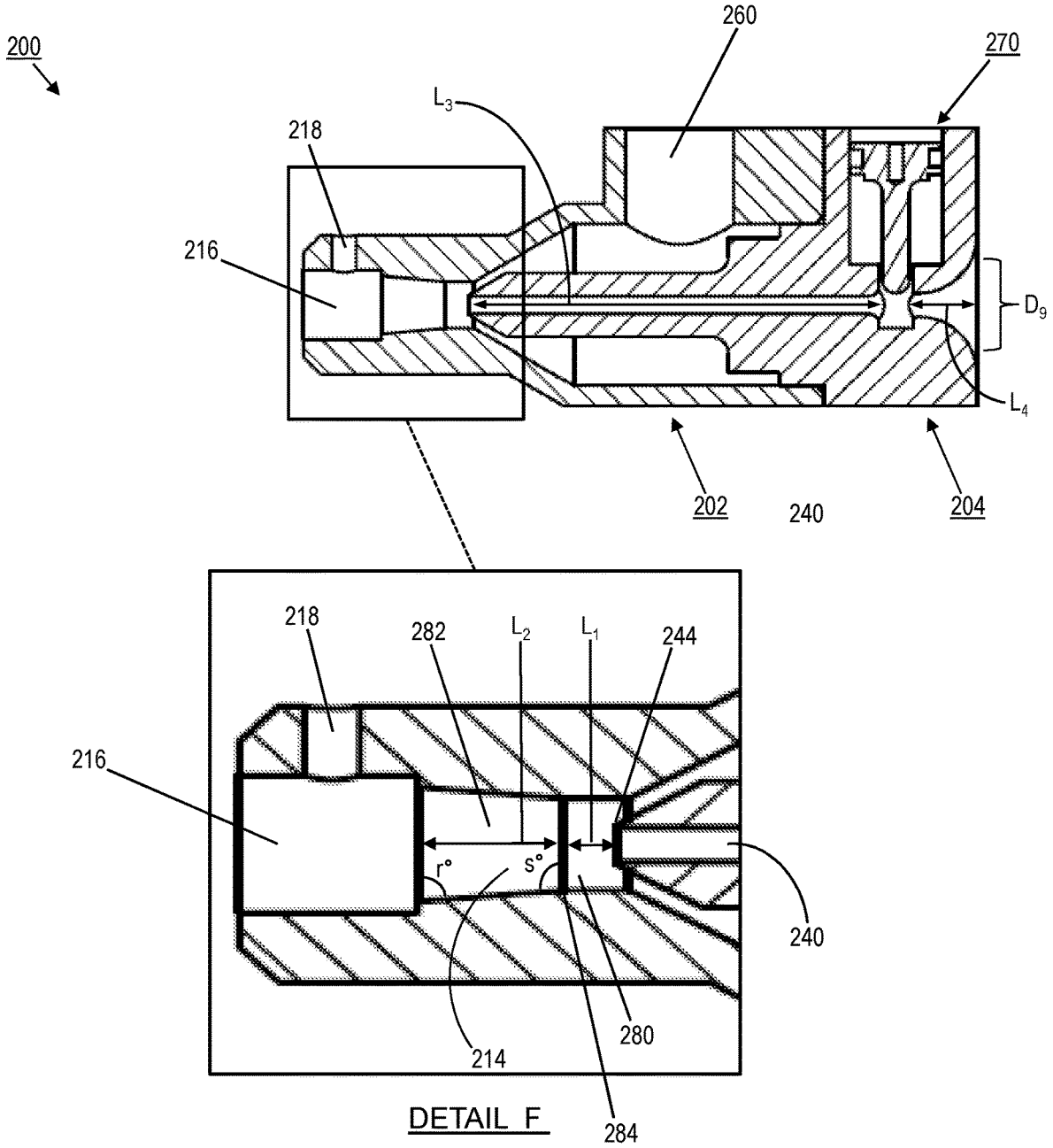
Figure 2H:
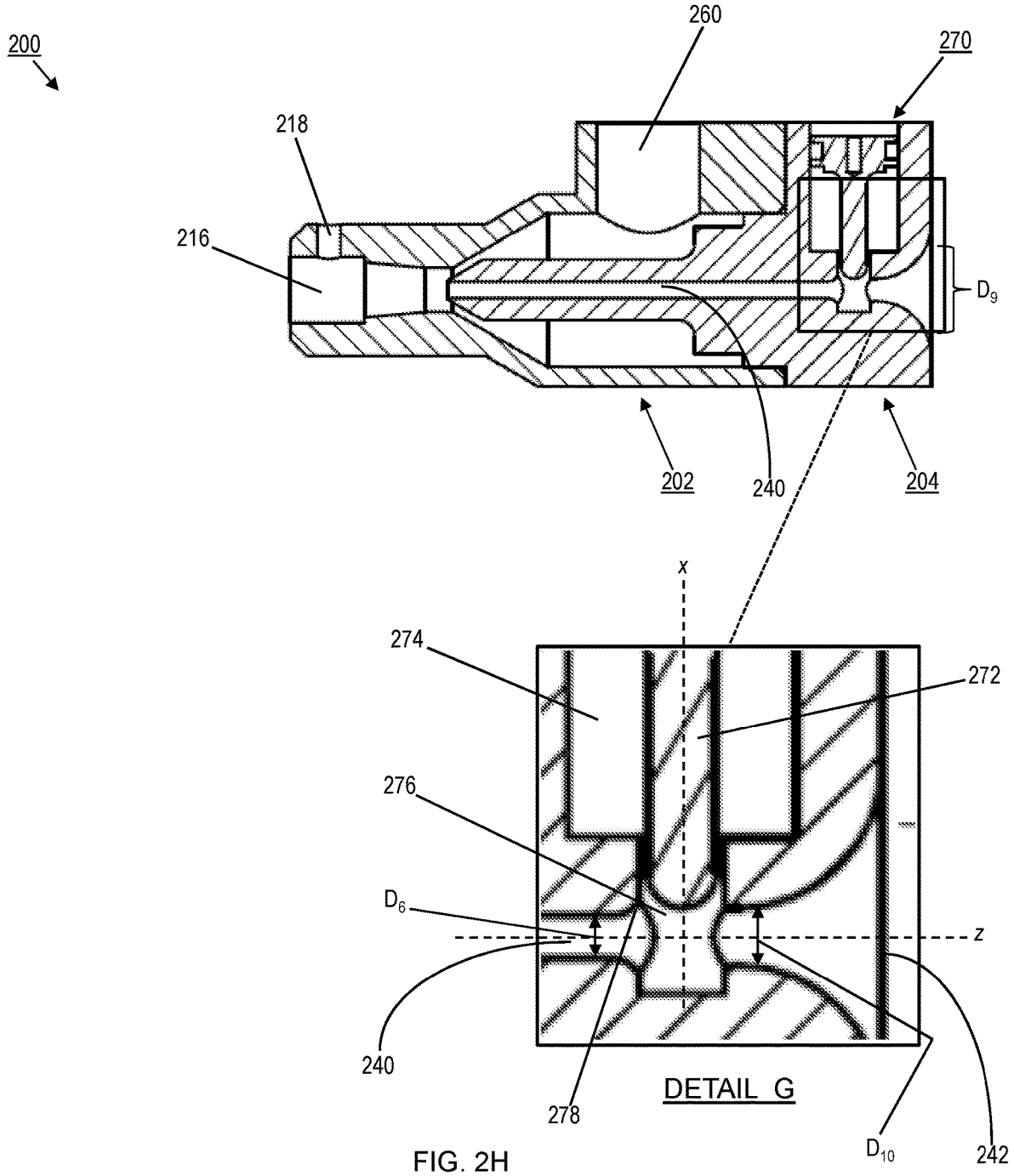

Furthermore, at least a portion of the region 278 where the channel 276 meets the first passage 240, on the side closest to the output opening 244, has a curved versus a sharp (e.g., 90 degree) transition, as shown in FIG. 2H. In addition to facilitating passage of the strand material into the first passage 240 as it passes the channel 276, it was discovered that this curved transition 278 reduced the incidence of shockwaves being created by the pressurized gas flowing back through the first passage 240. Such shockwaves are detrimental as they cause breakage of filaments from the strand material within the device.

The second passage 214 extends from the output opening 244 of the needle portion 234 to the cavity 216. The second passage 214 includes a first portion 280 and a second portion 282. The first portion 280 and the second portion 282 are separated by a transition 284, as shown in FIG. 2G.

A length $L_1$ of the first portion 280 is typically smaller than a length $L_2$ of the second portion 282. In some exemplary embodiments, the length $L_1$ is between 4 mm and 6 mm. In some exemplary embodiments, the length $L_1$ is 5 mm. In some exemplary embodiments, the length $L_2$ is between 10 mm and 12 mm. In some exemplary embodiments, the length $L_2$ is 11 mm.

The first portion 280 of the second passage 214 has a seventh diameter $D_7$ that is uniform along its length $L_1$ (see FIG. 2F). Accordingly, an inner surface 286 of the first portion 280 is parallel to the axis z. In some exemplary embodiments, the seventh diameter $D_7$ is between 7 mm and 9 mm. In some exemplary embodiments, the seventh diameter $D_7$ is 8 mm.

The second portion 282 of the second passage 214 has an eighth diameter $D_8$ that is not uniform along its length $L_2$ (see FIG. 2F). Accordingly, an inner surface 288 of the second portion 282 is not parallel to the axis z. Instead, the eighth diameter $D_8$ increases from the transition 284 to the cavity 216. In some exemplary embodiments, the eighth diameter $D_8$ varies from 7 mm to 11 mm along its length $L_2$. In some exemplary embodiments, the eighth diameter $D_8$ varies from 8 mm to 10 mm along its length $L_2$. Consequently, as shown in FIG. 2G, an angle s° is greater than 90°, while an angle r° is less than 90°.

The input opening 242 of the main body portion 232 has a ninth diameter $D_9$ that gradually transitions (i.e., decreases) to a tenth diameter $D_{10}$ within a portion 243 of the first passage 240 (i.e., before reaching the channel 276). In other words, the portion of the first passage 240 that extends between the channel 276 and the input opening 242 has a length $L_4$ and has a variable diameter that increases from the tenth diameter $D_{10}$ to the ninth diameter $D_9$ at the input opening 242. In some exemplary embodiments, the diameter of this portion of the first passage 240 varies from 4 mm to 26 mm. In some exemplary embodiments, the diameter of this portion of the first passage 240 varies from 5 mm to 25 mm. In some exemplary embodiments, the ninth diameter $D_9$ is between 24 mm and 26 mm. In some exemplary embodiments, the ninth diameter $D_9$ is 25 mm. In some exemplary embodiments, the tenth diameter $D_{10}$ is between 4 mm and 6 mm. In some exemplary embodiments, the tenth diameter $D_{10}$ is 5 mm. In general, the tenth diameter $D_{10}$ is larger than the sixth diameter $D_6$.

The gap $G_2$ that exists between the outer surface 256 of the needle portion 234 and the inner surface 248 of the intermediate portion 208 is substantially uniform within the device 200. In some exemplary embodiments, a horizontal measurement of the gap $G_2$ is between 1.4 mm and 2.0 mm. In some exemplary embodiments, a horizontal measurement of the gap $G_2$ is between 1.5 mm and 1.9 mm.

Texturized products produced by the device 200 can be used as acoustic and/or thermal insulation in automotive and industrial applications. Because of the specific features described above (alone or in combination), filaments that are broken off of and become separated from the strand material are more likely to be blown through and out of the device 200, as opposed to accumulating within the device 200. Consequently, the device 200 exhibits improved efficiency and/or reliability over conventional devices.

The above description of specific embodiments has been given by way of example. From the disclosure given, those skilled in the art will not only understand the general inventive concepts and their attendant advantages, but will also find apparent various changes and modifications to the structures and concepts disclosed. It is sought, therefore, to cover all such changes and modifications as fall within the spirit and scope of the general inventive concepts, as defined herein and by the appended claims, and equivalents thereof.

What is claimed is:

1. A device for texturizing a strand material, the device comprising:

a nozzle body; and a passage extending through the nozzle body, wherein the passage extends from a first end of the nozzle body to a second end of the nozzle body, wherein the passage is sized to allow a strand material to pass therethrough, wherein the strand material enters the nozzle body at the first end, wherein the strand material exits the nozzle body at the second end, and wherein a pressurized gas impinges on the strand material within the passage, wherein the passage has a first portion with a length $L_2$ and a non-uniform diameter $D_8$ over the length $L_2$, the diameter $D_8$ increasing in a direction moving toward the second end of the nozzle body, wherein the diameter $D_8$ increases from one of 7 mm to 11 mm and 8 mm to 10 mm over the length $L_2$, wherein the length $L_2$ is between 10 mm and 12 mm, wherein the nozzle body includes an outer nozzle section and an inner nozzle section, wherein the outer nozzle section includes a sloped intermediate portion, wherein the inner nozzle section includes a sloped needle portion, wherein at least a portion of the inner nozzle section is positioned within the outer nozzle section such that a conical gap $G_2$ exists between an inner surface of the sloped intermediate portion and an outer surface of the sloped needle portion, wherein the pressurized gas flows from a chamber within the nozzle body through the gap $G_2$ before impinging on the strand material within the passage, and wherein a horizontal distance of the gap $G_2$ is between 1.5 mm and 1.9 mm.

2. The device of claim 1, wherein the length $L_2$ is 11 mm.

3. The device of claim 1, further characterized by the passage having a second portion with a length $L_1$ and a uniform diameter $D_7$ over the length $L_1$, wherein the second portion is adjacent to the first portion, and wherein the second portion is closer to the first end of the nozzle body than the first portion is to the first end of the nozzle body.

4. The device of claim 3, wherein the length $L_1$ is between 4 mm and 6 mm.

5. The device of claim 3, wherein the length $L_1$ is 5 mm.

6. The device of claim 3, wherein the diameter $D_7$ is between 7 mm and 9 mm.

7. The device of claim 3, wherein the diameter $D_7$ is 8 mm.

8. The device of claim 3, wherein the pressurized gas first impinges on the strand material within the second portion of the passage.

9. The device of claim 3, further comprising a locking device, wherein the locking device is operable to be selectively placed in one of a first state and a second state, wherein the first state corresponds to the locking device being engaged to prevent movement of the strand material within the passage, wherein the second state corresponds to the locking device being disengaged to allow movement of the strand material within the passage, wherein the locking device includes a piston and a spring disposed within a cavity, and wherein a seal holder is disposed within the cavity to fix a sealing member within the cavity, and wherein the sealing member at least partially prevents debris from entering the cavity from the passage.

10. The device of claim 9, wherein the cavity is connected to the passage by a channel, wherein the channel is sized to allow a portion of the piston to exit the cavity and enter the passage, and wherein at least a portion of the interface between the channel and the passage has an arcuate shape.

11. The device of claim 10, further characterized by the passage having a third portion with a length $L_3$ and a uniform dimeter $D_6$ over the length $L_3$, wherein the third portion extends between the second portion and the channel.

12. The device of claim 11, wherein the length $L_3$ is between 70 mm and 75 mm.

13. The device of claim 11, wherein the length $L_3$ is 72.4 mm.

14. The device of claim 11, wherein the diameter $D_6$ is between 2 mm and 5 mm.

15. The device of claim 11, wherein the diameter $D_6$ is 3 mm.

16. The device of claim 11, wherein the diameter $D_6$ is 4 mm.

17. The device of claim 11, further characterized by the passage having a fourth portion with a length $L_4$ and a non-uniform diameter $d_4$ that increases from a first diameter $D_{10}$ to a second diameter $D_9$ over the length $L_4$ in a direction moving toward the first end of the nozzle body, wherein the fourth portion extends between the channel and the first end of the nozzle body.

18. The device of claim 17, wherein the length $L_4$ is between 8 mm and 12 mm.

19. The device of claim 17, wherein the length $L_4$ is 10 mm.

20. The device of claim 17, wherein the diameter $d_4$ increases from 4 mm to 26 mm over the length $L_4$.

21. The device of claim 17, wherein the diameter $d_4$ increases from 5 mm to 25 mm over the length $L_4$.

22. The device of claim 17, further characterized by the passage having a fifth portion with a length $l_5$ and a uniform diameter $d_5$ over the length $I_5$, wherein the fifth portion extends between the first portion and the second end of the nozzle body.

23. The device of claim 22, wherein the length $l_5$ is between 5 mm and 20 mm.

24. The device of claim 22, wherein the length $l_5$ is 13.5 mm.

25. The device of claim 22, wherein the diameter $d_5$ is between 9 mm and 15 mm.

26. The device of claim 22, wherein the diameter $d_5$ is 12 mm.

27. The device of claim 22, further comprising an outlet tube, wherein at least a portion of the outlet tube fits within the fifth portion, wherein the outlet tube is removably attached to the nozzle body, and wherein the strand material is operable to pass through the outlet tube before exiting the device.

28. The device of claim 27, wherein the outlet tube is secured to the nozzle body by a set screw.

29. The device of claim 1, wherein the pressurized fluid gas is compressed air.

* * * * *